US005480026A

United States Patent [19]

Darling et al.

[11] Patent Number: 5,480,026

[45] Date of Patent: Jan. 2, 1996

[54] BOCCI BALL CADDY

[76] Inventors: David W. Darling; Judy S. Darling, both of 195 Sharon Dr., Rochester, N.Y. 14626

[21] Appl. No.: 373,610

[22] Filed: Jan. 17, 1995

[51] Int. Cl.[6] ..... B65D 61/00; A63B 71/00

[52] U.S. Cl. ..... 206/315.9; 206/485; 211/14; 211/126

[58] Field of Search ..... 211/14, 126; 206/315.9, 206/315.91, 315.1, 485

[56] References Cited

U.S. PATENT DOCUMENTS

| | | | |
|---|---|---|---|
| 3,355,027 | 11/1967 | Gibbons | 211/14 X |
| 3,980,215 | 9/1976 | Schwarzbauer | 211/14 X |
| 4,890,731 | 1/1990 | Mroz | 206/315.9 |
| 4,993,548 | 2/1991 | Peterson | 206/315.9 X |
| 5,135,275 | 8/1992 | Kettelson | 206/315.91 X |
| 5,158,179 | 10/1992 | Gosselin | 206/315.1 |

*Primary Examiner*—Jacob K. Ackun

[57] ABSTRACT

A bocci ball caddy including a pair of similarly shaped halves, each half having a top rail, an opposed aligned bottom rail, and a plurality of coplanar and parallel cylindrical spaced bars extended therebetween; a hinge mechanism secured between the bottom rails of the halves for allowing the halves to be folded into an orientation with the top rails placed in opposition, the bottom rails placed in opposition, and each bar of one half positioned in a spaced and symmetrically aligned offset relation to a corresponding bar of the other half to define a coupling bar pair and with adjacently positioned coupling bar pairs defining a holding space therebetween for holding a plurality of bocci balls in a linear stacked sequence; and a coupling mechanism for coupling the halves together.

7 Claims, 4 Drawing Sheets

FIG 5
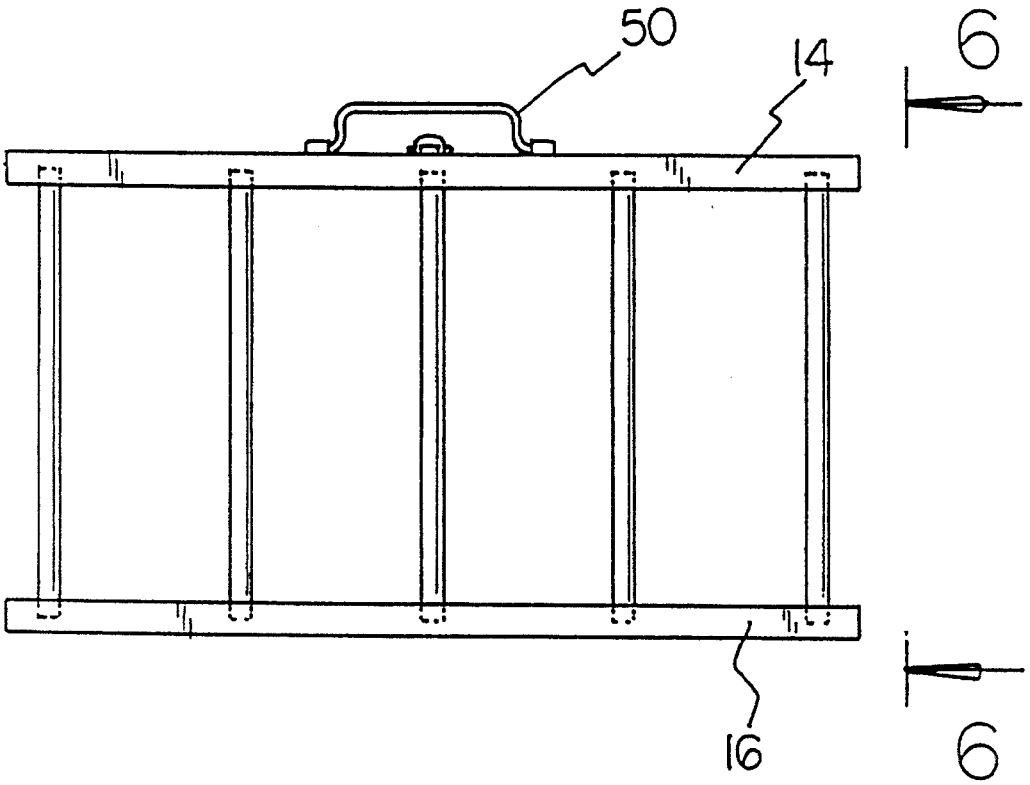
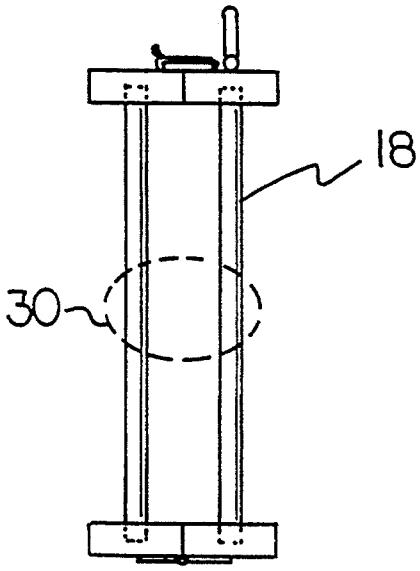
FIG 6

FIG 7
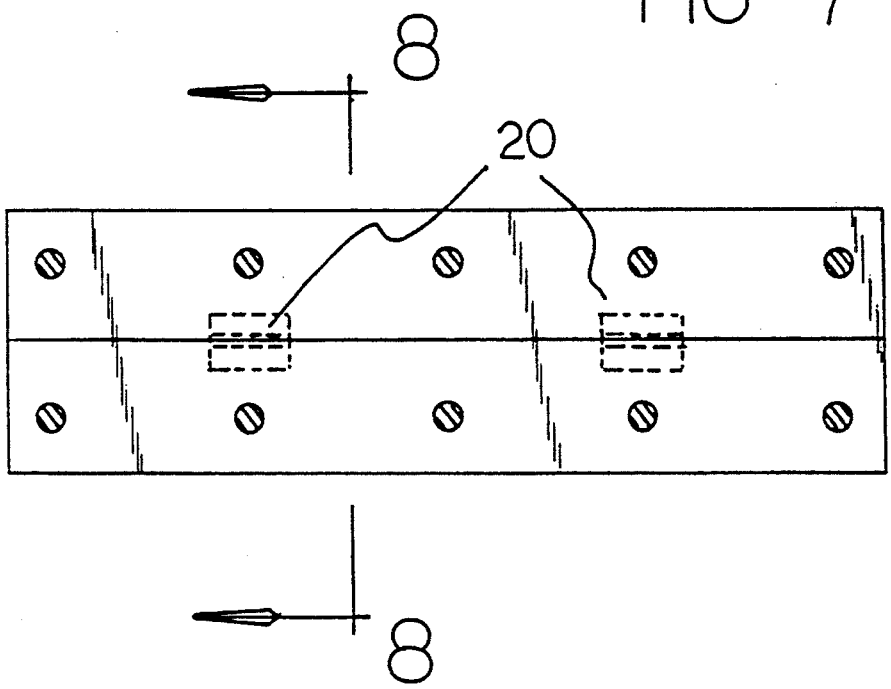
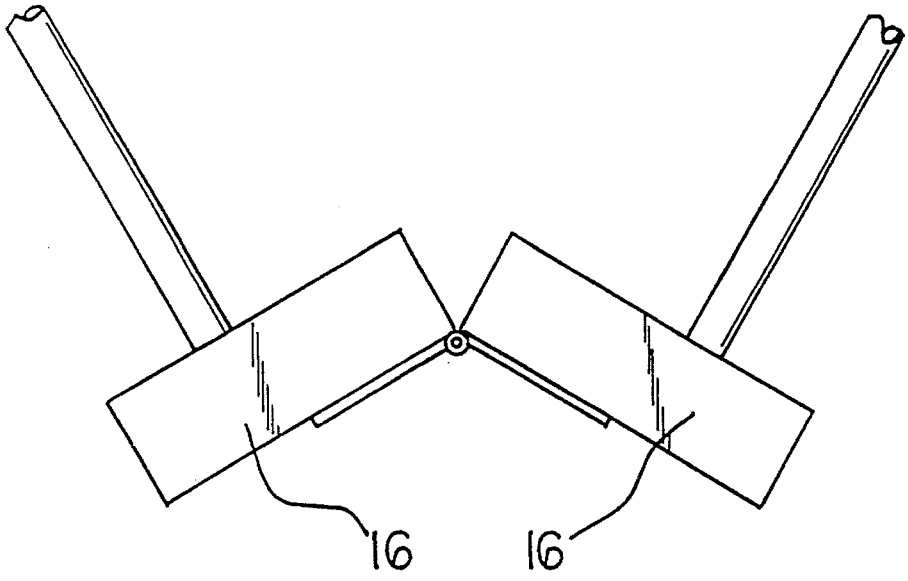
FIG 8

BOCCI BALL CADDY

BACKGROUND OF THE INVENTION

1. Field of the Invention

The present invention relates to a bocci ball caddy and more particularly pertains to allowing a user to transport standard-sized bocci balls from one location to another with a bocci ball caddy.

2. Description of the Prior Art

The use of ball holders is known in the prior art. More specifically, ball holders heretofore devised and utilized for the purpose of allowing a user to transport a ball from one location to another are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,685,202 to Morrison discloses a ball carrier. U.S. Pat. No. 3,756,299 to Simmons et al. discloses a ball carrier. U.S. Pat. No. 3,968,912 to Horwitz discloses a ball and racket carrier. U.S. Pat. No. 4,062,482 to Szalony discloses an integrally formed ball carrier. U.S. Pat. No. 4,284,217 to Johnston et al. discloses a ball carrier.

While these devices fulfill their respective, particular objective and requirements, the aforementioned patents do not describe a bocci ball caddy that allows a plurality of bocci balls to be readily transported from one location to another.

In this respect, the bocci ball caddy according to the present invention substantially departs from the conventional concepts and designs of the prior art, and in doing so provides an apparatus primarily developed for the purpose of allowing a user to transport standard-sized bocci balls from one location to another.

Therefore, it can be appreciated that there exists a continuing need for new and improved bocci ball caddy which can be used for allowing a user to transport standard-sized bocci balls from one location to another. In this regard, the present invention substantially fulfills this need.

SUMMARY OF THE INVENTION

In the view of the foregoing disadvantages inherent in the known types of ball holders now present in the prior art, the present invention provides an improved bocci ball caddy. As such, the general purpose of the present invention, which will be described subsequently in greater detail, is to provide a new and improved bocci ball caddy and method which has all the advantages of the prior art and none of the disadvantages.

To attain this, the present invention essentially comprises, in combination, a pair of similarly shaped halves. Each half has a top rail, an opposed aligned bottom rail, and five coplanar and parallel rigid cylindrical spaced linear bars extended therebetween. Each bar has a diameter of about ⅜ inches. The spacing between adjacent bars coupled to the same rails is about 4⅛ inches. A pair of hinges are included and secured between the bottom rails of the halves. The hinges allow the halves to be folded into an orientation with the top rails placed in contact, the bottom rails placed in contact, and each bar of one half positioned in a spaced and symmetrically aligned offset relation to a corresponding bar of the other half to define a coupling bar pair. The spacing between the bars of each coupling bar pair is about 1⅞ inches. Adjacently positioned coupling bar pairs define a holding space therebetween for holding two bocci balls in a linear stacked sequence. The hinges further allow the halves to be unfolded with the bars of the halves positioned in a common plane. A latch is included and formed of a hook portion coupled to one of the top rails of one of the halves and a loop portion coupled to the other top rail of the other half. The loop portion is securable to the hook portion for locking the folded halves together. Lastly, a generally rigid U-shaped carrying handle is included and coupled to one of the top rails at the midpoint thereof near the latch.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bocci ball caddy which has all the advantages of the prior art ball holders and none of the disadvantages.

It is another object of the present invention to provide a new and improved bocci ball caddy which may be easily and efficiently manufactured and marketed.

It is a further object of the present invention to provide a new and improved bocci ball caddy which is of durable and reliable construction.

An even further object of the present invention is to provide a new and improved bocci ball caddy which is susceptible of a low cost of manufacture with regard to both materials and labor, and which accordingly is then susceptible of low prices of sale to the consuming public, thereby making such a bocci ball caddy economically available to the buying public.

Still yet another object of the present invention is to provide a new and improved bocci ball caddy which provides in the apparatuses and methods of the prior art some of the advantages thereof, while simultaneously overcoming some of the disadvantages normally associated therewith.

Even still another object of the present invention is to provide a new and improved bocci ball caddy for allowing a user to transport standard-sized bocci balls from one location to another.

Lastly, it is an object of the present invention to provide a new and improved bocci ball caddy comprising a pair of similarly shaped halves, each half having a top rail, an opposed aligned bottom rail, and a plurality of coplanar and parallel cylindrical spaced bars extended therebetween; a hinge mechanism secured between the bottom rails of the halves for allowing the halves to be folded into an orientation with the top rails placed in opposition, the bottom rails placed in opposition, and each bar of one half positioned in a spaced and symmetrically aligned offset relation to a corresponding bar of the other half to define a coupling bar pair and with adjacently positioned coupling bar pairs defining a holding space therebetween for holding a plurality of bocci balls in a linear stacked sequence; and a coupling mechanism for coupling the halves together.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a side-elevational view of the present invention.

FIG. 6 is yet another side-elevational view of the present invention taken along the line 6—6 of FIG. 5.

FIG. 7 is a bottom plan view of the present invention.

FIG. 8 is a view of the present invention taken along the line 8—8 of FIG. 7.

The same reference numerals refer to the same parts through the various Figures.

DESCRIPTION OF THE PREFERRED EMBODIMENT

Figure 1:
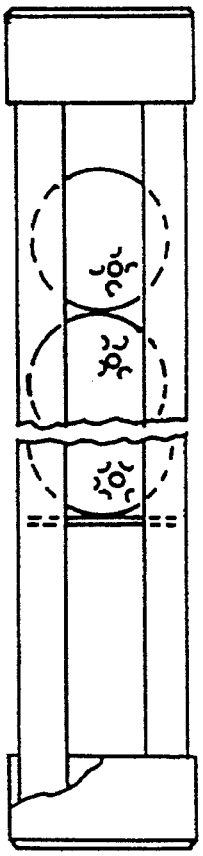
FIG 1 PRIOR ART
FIG. 1 is a side-elevational view of a prior art ball carrier.
Figure 2:
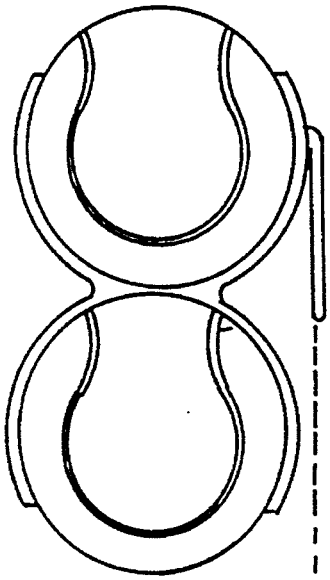
FIG 2 PRIOR ART
FIG. 2 is a plan view of a prior art ball carrier.

With reference now to the drawings, and in particular, to FIGS. 3 through 8 thereof, the preferred embodiment of the new and improved bocci ball caddy embodying the principles and concepts of the present invention and generally designated by the reference number 10 will be described.

The present invention is comprised of a plurality of components. In their broadest context, such components include rails, bars, hinges, a latch, and a handle. Such components are individually configured and correlated with respect to each other to provide the intended function of allowing a user to transport a plurality of standard-sized bocci balls 11 from one location to another. A standard-sized bocci ball has a diameter of about 4⅔ inch.

Specifically, the present invention includes a pair of similarly shaped halves 12. Each half has a top rail 14 and an opposed bottom rail 16. The bottom rail is aligned and offset directly below the top rail. Each rail is generally rectangular in structure and formed of a rigid material such as wood, plastic, or metal. Additionally, each half includes five coplanar and parallel spaced bars 18. Each bar is cylindrical and linear in structure. Each bar is formed of a rigid material such as wood, plastic, or metal. Each bar is extended between and coupled to a top rail and a corresponding bottom rail. Each bar further has a diameter of about ⅜ inch. The spacing between adjacent bars coupled to a the same top and bottom rails is about 4⅛ inch.

Figure 3:
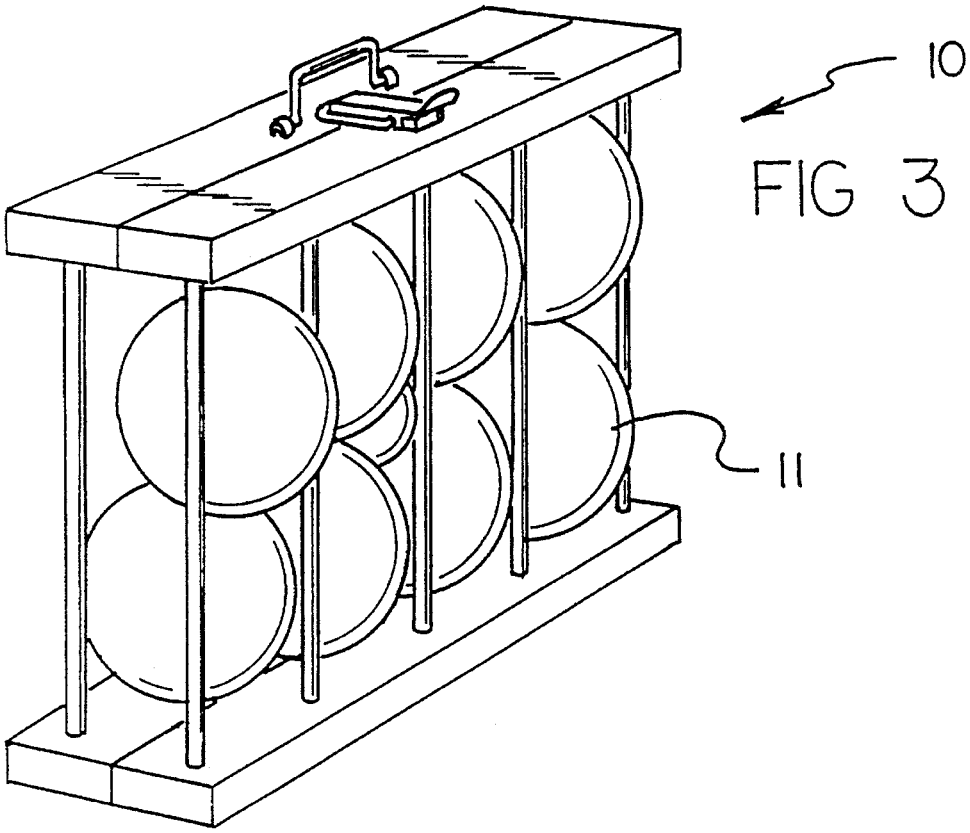
FIG. 3 is a perspective view of the preferred embodiment constructed in accordance with the principles of the present invention holding bocci balls therein for transport.

Also provided is a pair of hinges 20 as shown in FIG. 7. The hinges are secured between the bottom rails of the halves. The hinges allow the halves to be folded into an orientation with the top rails placed in contact, the bottom rails placed in contact, and each bar of one half positioned in a spaced and symmetrically aligned offset relation to a corresponding bar of the other half to define a coupling bar pair 30 as shown in FIG. 6. The spacing between the bars of each coupling bar pair is about 1⅞ inch. Furthermore, adjacently positioned coupling bar pairs define a holding space therebetween. This holding space is used for holding two bocci balls in a linear stacked sequence as shown in FIG. 3. Thus, since the present invention has five pair of coupling bar pairs, it can hold a maximum of ten bocci balls. Furthermore, the hinges allow the halves to be unfolded as shown in FIG. 8 for unloading bocci balls. The halves may be unfolded in a full extension such that the bars are positioned in a common plane.

Figure 4:
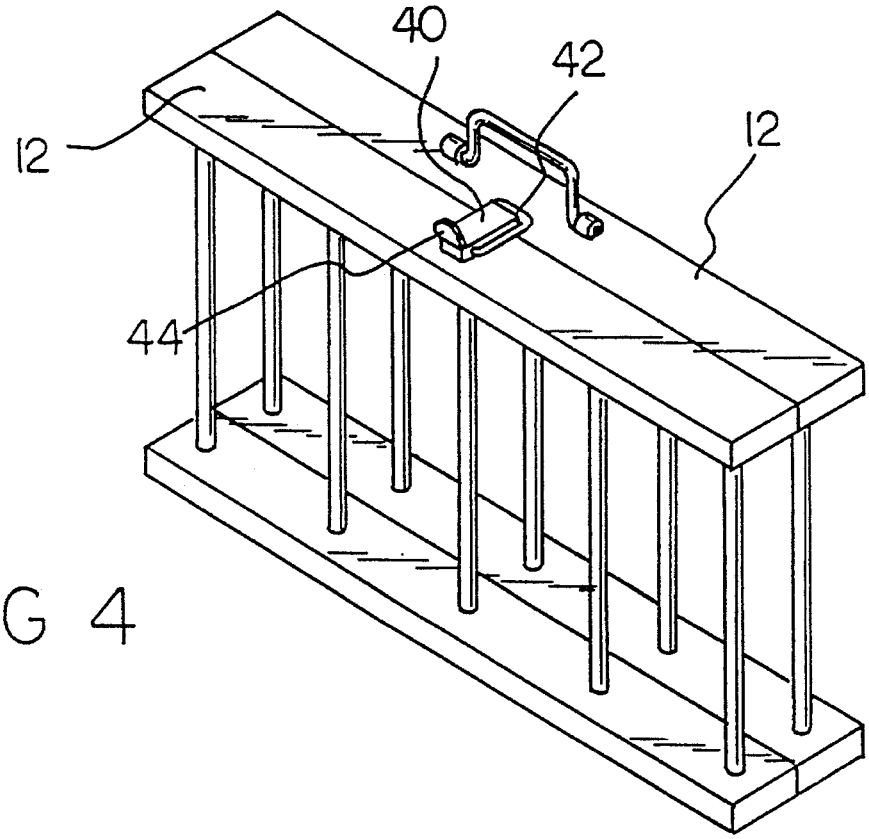
FIG. 4 is yet another perspective view of the preferred embodiment of the present invention.

Also provided is a latch 40 as shown in FIG. 4. The latch is formed of a hook portion coupled to one of the top rails of one of the halves and a loop portion 42 coupled to the other top rail of the other half. The loop portion is removably securable to the hook portion 44 for locking the folded halves together.

Lastly, a generally rigid U-shaped carrying handle 50 is included. The carrying handle is coupled to one of the top rails at the midpoint thereof near the latch. The carrying handle allows a user a firm grip for carrying the caddy from one location to another.

The present invention is not limited to the embodiment as described above. The present invention can also be formed with longer bars such that more bocci balls may be carried. Furthermore, the present invention can be provided with more bars for holding additional sequences of bocci balls.

The present invention is a sturdy wooden holder that bocci ball players can use to carry and store standard-sized bocci ball sets. The overall dimensions of the present invention are 11 inches in height, 20 inches in length, and 4½ inches in depth when the halves are coupled together. A pair of wooden rails are coupled together in a side-by-side relationship with two 1½ inch metal cabinet hinges to form the bottom of the holder. An additional pair of wooden rails with the same dimensions form the top of the holder. These top rails are removable connectable with a metal chest latch. A 4⅞ inch metal pull handle is attached one of the top rails. Five pairs of ⅜ inch diameter wooden bars are set into the two pairs of rails at 4½ inch intervals. The sides of the holder are open. Each rail of the present invention is 2¼ inches in width by ¾ inches in thickness by 20 inches in length. Each bar of the present invention is cylindrical with a 10¼ inch length.

A player uses the handle to carry the present invention. To open the present invention, the player lays the piece on its side, releases the latch, and swings open the top half of the holder. The player can now remove the balls from within the holder. When a bocci ball game is finished, a player can insert the balls in the open holder, then swing the two planks together and close the latch. The balls remain in the holder for storage until the next game. The present invention is sturdy in construction and is far superior to the traditional cardboard or cloth holders conventionally used with bocci ball sets. The present invention is designed to hold balls securely without shifting. The present invention is comfortable to hold and easy to carry.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A bocci ball caddy for allowing a user to transport standard-sized bocci balls from one location to another comprising, in combination:

a pair of similarly shaped halves, each half having a top rail, an opposed aligned bottom rail, and five coplanar and parallel rigid cylindrical spaced linear bars extended therebetween with each bar having a diameter of about ⅜ inches and with the spacing between adjacent bars being about 4⅛ inches;

a pair of hinges secured between the bottom rails of the halves for allowing the halves to be folded into an orientation with the top rails placed in contact, the bottom rails placed in contact, and each bar of one half positioned in a spaced and symmetrically aligned offset relation to a corresponding bar of the other half to define a coupling bar pair with the spacing between the bars of each coupling bar pair being about 1⅞ inches and with adjacently positioned coupling bar pairs defining a holding space therebetween for holding two bocci balls in a linear stacked sequence, the hinges further allowing the halves to be unfolded with the bars positioned in a common plane;

a latch formed of a hook portion coupled to one of the top rails of one of the halves and a loop portion coupled to the other top rail of the other half and with the loop portion securable to the hook portion for locking the folded halves together; and a generally rigid U-shaped carrying handle coupled to one of the top rails at the midpoint thereof near the latch.

2. A bocci ball caddy comprising:

a pair of similarly shaped halves, each half having a top rail, an opposed aligned bottom rail, and a plurality of coplanar and parallel cylindrical spaced bars extended therebetween;

a hinge mechanism secured between the bottom rails of the halves for allowing the halves to be folded into an orientation with the top rails placed in opposition, the bottom rails placed in opposition, and each bar of one half positioned in a spaced and symmetrically aligned offset relation to a corresponding bar of the other half to define a coupling bar pair and with adjacently positioned coupling bar pairs defining a holding space therebetween for holding a plurality of bocci balls in a linear stacked sequence; and a coupling mechanism for coupling the halves together.

3. The bocci ball caddy as set forth in claim 2 wherein each bar is linear.

4. The bocci ball caddy as set forth in claim 2 wherein each bar is linear and has a diameter of about ⅜ inches and the spacing between adjacent bars coupled to one of the rails is about 4⅛ inches.

5. The bocci ball caddy as set forth in claim 2 wherein each bar is linear and the spacing between the bars of each coupling bar pair is about 1⅞ inches.

6. The bocci ball caddy as set forth in claim 2 wherein the coupling mechanism is a latch formed of a hook portion coupled to one of the top rails of one of the halves and a loop portion coupled to the other top rail of the other half and with the loop portion securable to the hook portion for locking the folded halves together.

7. The bocci ball caddy as set forth in claim 2 further including a carrying handle coupled to one of the top rails.

* * * * *